US009076319B2

(12) United States Patent
Boisclair et al.

(10) Patent No.: US 9,076,319 B2
(45) Date of Patent: Jul. 7, 2015

(54) USER INTERFACE BROKER FOR FIRE ALARM SYSTEMS

(71) Applicant: SimplexGrinnell LP, Westminster, MA (US)

(72) Inventors: Mario Boisclair, Montreal (CA); Joseph Piccolo, III, Fitzwilliam, NH (US); Dennis McEvoy, Groton, MA (US); Mary Winna Fox, Nashville, TN (US); Kirill Alexandrov, Longueuil (CA)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 141 days.

(21) Appl. No.: 13/688,441

(22) Filed: Nov. 29, 2012

(65) Prior Publication Data

US 2014/0145855 A1 May 29, 2014

(51) Int. Cl.

| | |
|---|---|
| ***G08B 7/00*** | (2006.01) |
| ***G08B 25/14*** | (2006.01) |
| *G08B 17/00* | (2006.01) |

(52) U.S. Cl.

CPC ..... *G08B 25/14* (2013.01); *G08B 17/00* (2013.01)

(58) Field of Classification Search

CPC ..... G08B 25/14; G08B 29/14; G08B 29/123; G08B 29/145; G08B 17/00; G08B 5/36; G08B 3/10; G08B 13/08; G08B 23/00

USPC ..... 340/506, 5.1, 999, 531, 628, 632, 340/573.1, 691.8, 286.05, 514; 700/79, 80; 73/1.01–1.07

See application file for complete search history.

(56) References Cited

U.S. PATENT DOCUMENTS

| | | | | |
|---|---|---|---|---|
| 7,227,450 | B2 * | 6/2007 | Garvy et al. | 340/286.05 |
| 8,723,665 | B2 * | 5/2014 | Foisy et al. | 340/506 |
| 2005/0190055 | A1 * | 9/2005 | Petite | 340/531 |
| 2008/0079560 | A1 * | 4/2008 | Hall et al. | 340/506 |
| 2011/0254681 | A1 * | 10/2011 | Perkinson et al. | 340/506 |

* cited by examiner

*Primary Examiner* — Anh V La

(74) *Attorney, Agent, or Firm* — Kacvinsky Daisak Bluni PLLC

(57) ABSTRACT

An interface system for providing a comprehensive user interface for alarm systems. The interface system may include two or more alarm system workstations, each having a user interface application installed thereon. One or more alarm panels may be connected to each of the alarm system workstations, and one or more points may be connected to each of the alarm panels. A broker workstation may be connected to the two or more alarm system workstations, and one or more client workstations may be connected to the broker workstation. A user interface broker may be installed on the broker workstation, wherein the user interface broker is configured to provide the one or more client workstations with a user interface that presents the status of, and that provides control over, all of the points.

23 Claims, 10 Drawing Sheets

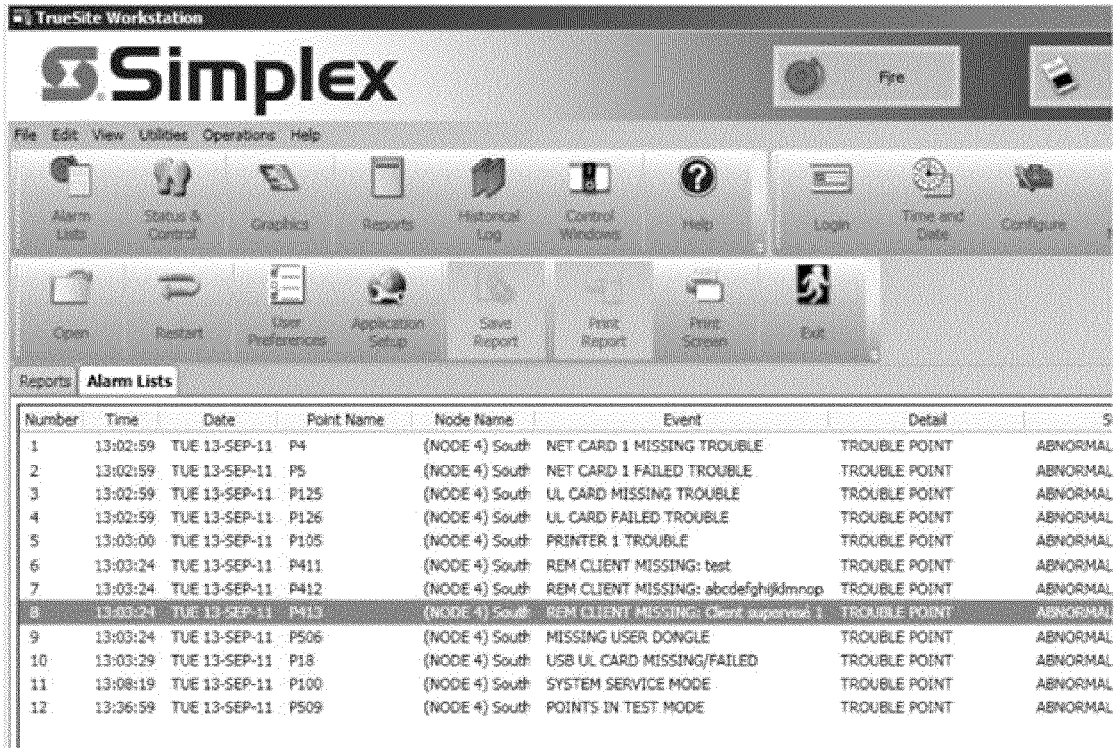

| Number | Time | Date | Point Name | Node Name | Event | Detail | S |
|---|---|---|---|---|---|---|---|
| 1 | 13:02:59 | TUE 13-SEP-11 | P4 | (NODE 4) South | NET CARD 1 MISSING TROUBLE | TROUBLE POINT | ABNORMAL |
| 2 | 13:02:59 | TUE 13-SEP-11 | P5 | (NODE 4) South | NET CARD 1 FAILED TROUBLE | TROUBLE POINT | ABNORMAL |
| 3 | 13:02:59 | TUE 13-SEP-11 | P125 | (NODE 4) South | UL CARD MISSING TROUBLE | TROUBLE POINT | ABNORMAL |
| 4 | 13:02:59 | TUE 13-SEP-11 | P126 | (NODE 4) South | UL CARD FAILED TROUBLE | TROUBLE POINT | ABNORMAL |
| 5 | 13:03:00 | TUE 13-SEP-11 | P105 | (NODE 4) South | PRINTER 1 TROUBLE | TROUBLE POINT | ABNORMAL |
| 6 | 13:03:24 | TUE 13-SEP-11 | P411 | (NODE 4) South | REM CLIENT MISSING: test | TROUBLE POINT | ABNORMAL |
| 7 | 13:03:24 | TUE 13-SEP-11 | P412 | (NODE 4) South | REM CLIENT MISSING: abcdefghijklmnop | TROUBLE POINT | ABNORMAL |
| 8 | 13:03:24 | TUE 13-SEP-11 | P413 | (NODE 4) South | REM CLIENT MISSING: Client supervisor 1 | TROUBLE POINT | ABNORMAL |
| 9 | 13:03:24 | TUE 13-SEP-11 | P506 | (NODE 4) South | MISSING USER DONGLE | TROUBLE POINT | ABNORMAL |
| 10 | 13:03:29 | TUE 13-SEP-11 | P18 | (NODE 4) South | USB UL CARD MISSING/FAILED | TROUBLE POINT | ABNORMAL |
| 11 | 13:08:19 | TUE 13-SEP-11 | P100 | (NODE 4) South | SYSTEM SERVICE MODE | TROUBLE POINT | ABNORMAL |
| 12 | 13:36:59 | TUE 13-SEP-11 | P509 | (NODE 4) South | POINTS IN TEST MODE | TROUBLE POINT | ABNORMAL |

FIG. 6

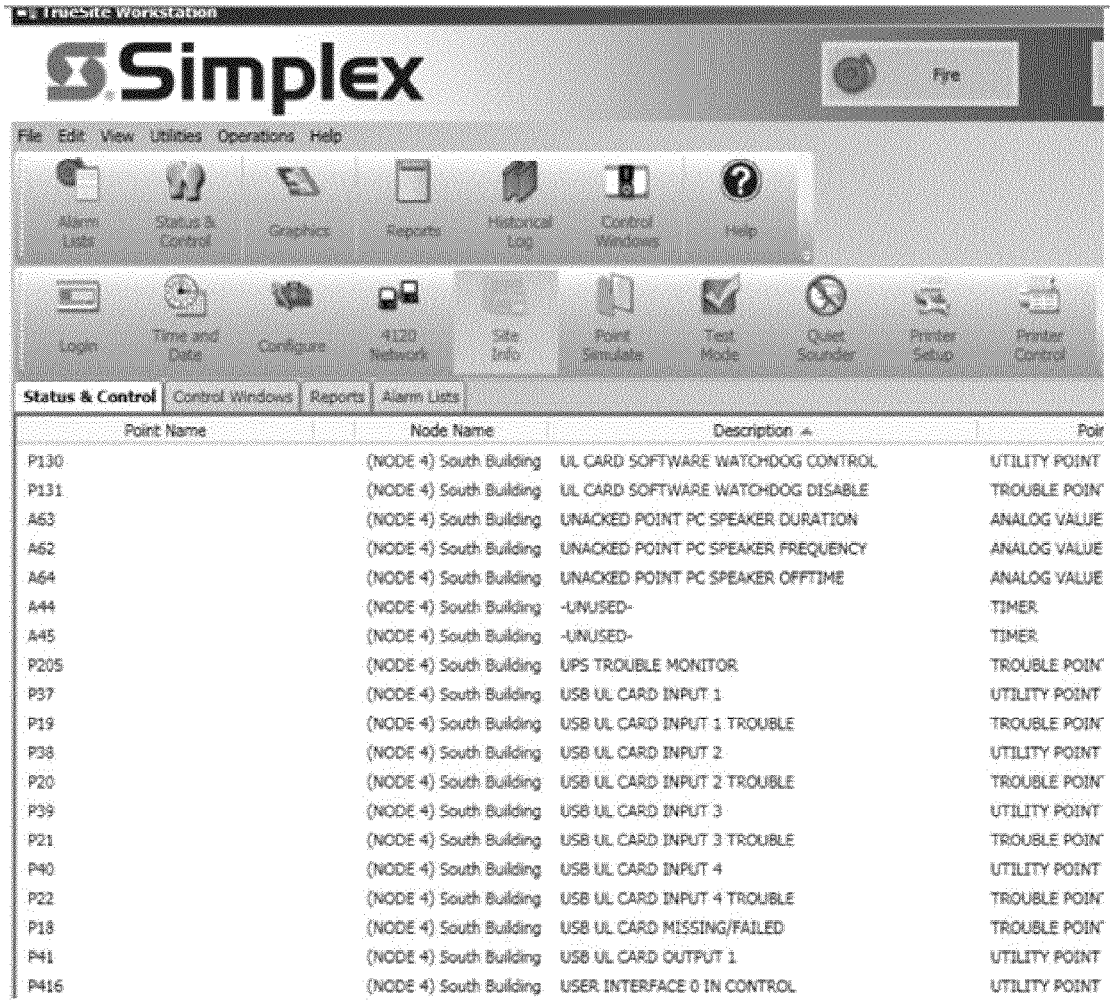

| Point Name | Node Name | Description | Poir |
|---|---|---|---|
| P130 | (NODE 4) South Building | UL CARD SOFTWARE WATCHDOG CONTROL | UTILITY POINT |
| P131 | (NODE 4) South Building | UL CARD SOFTWARE WATCHDOG DISABLE | TROUBLE POIN |
| A63 | (NODE 4) South Building | UNACKED POINT PC SPEAKER DURATION | ANALOG VALUE |
| A62 | (NODE 4) South Building | UNACKED POINT PC SPEAKER FREQUENCY | ANALOG VALUE |
| A64 | (NODE 4) South Building | UNACKED POINT PC SPEAKER OFFTIME | ANALOG VALUE |
| A44 | (NODE 4) South Building | -UNUSED- | TIMER |
| A45 | (NODE 4) South Building | -UNUSED- | TIMER |
| P205 | (NODE 4) South Building | UPS TROUBLE MONITOR | TROUBLE POIN |
| P37 | (NODE 4) South Building | USB UL CARD INPUT 1 | UTILITY POINT |
| P19 | (NODE 4) South Building | USB UL CARD INPUT 1 TROUBLE | TROUBLE POIN |
| P38 | (NODE 4) South Building | USB UL CARD INPUT 2 | UTILITY POINT |
| P20 | (NODE 4) South Building | USB UL CARD INPUT 2 TROUBLE | TROUBLE POIN |
| P39 | (NODE 4) South Building | USB UL CARD INPUT 3 | UTILITY POINT |
| P21 | (NODE 4) South Building | USB UL CARD INPUT 3 TROUBLE | TROUBLE POIN |
| P40 | (NODE 4) South Building | USB UL CARD INPUT 4 | UTILITY POINT |
| P22 | (NODE 4) South Building | USB UL CARD INPUT 4 TROUBLE | TROUBLE POIN |
| P18 | (NODE 4) South Building | USB UL CARD MISSING/FAILED | TROUBLE POIN |
| P41 | (NODE 4) South Building | USB UL CARD OUTPUT 1 | UTILITY POINT |
| P416 | (NODE 4) South Building | USER INTERFACE 0 IN CONTROL | UTILITY POINT |

FIG. 7

USER INTERFACE BROKER FOR FIRE ALARM SYSTEMS

FIELD OF THE DISCLOSURE

The disclosure relates generally to the field of alarm systems, and more particularly to a system and method for providing a comprehensive user interface for monitoring and controlling a plurality of alarm systems.

BACKGROUND OF THE DISCLOSURE

Alarm systems, such as fire alarm and security systems, typically include one or more centralized alarm panels that receive information from various sensors that are distributed throughout a structure or area. For example, referring to FIG. 1, a typical fire alarm system 10 may include a plurality of initiating devices 12 (e.g. smoke detectors, manually-actuated pull stations, etc.) that are connected to one or more alarm panels 14. During normal operation of the alarm system 10, the alarm panel 14 may monitor electrical signals associated with each of the initiating devices 12 for variations that may represent the occurrence of an alarm condition. For example, a variation in a particular electrical signal may represent the detection of smoke by a smoke detector in a corresponding area, or "zone," of a building in which the smoke detector is located, and may cause the alarm panel 14 to enter an alarm mode. The alarm panel 14 may be configured to respond to such a condition by initiating certain predefined actions, such as activating one or more notification appliances 16 (e.g. strobes, sirens, public announcement systems, etc.) within the monitored building.

The exemplary alarm system 10 may also include a workstation 18, such as a personal computer (PC) or server, which is operatively connected to the alarm panel 14 of the alarm system 10. If the alarm system 10 includes a plurality of alarm panels 14, the panels 14 may be networked, such as in a ring configuration, and the workstation 18 may be connected to the network as a network node as shown in FIG. 2. The workstation 18 may be loaded with one or more software applications that provide human operators of the system 10 with a user interface (UI) for monitoring and controlling certain aspects of the alarm system 10. For example, a UI may provide an operator with a graphical representation of the alarm system 10, including all of the individual initiating devices 12 and notification appliances 16 (collectively referred to as "points") within the system 10. The UI may allow an operator to observe the functional status of the points 12 and 16, and may further allow the operator to activate, deactivate, or otherwise exert control over the operation of the points 12 and 16. For example, the UI may allow an operator to readily determine whether a particular point in the system is functioning properly, and to dispatch service personnel if it is not. The UI may further allow an operator to determine the specific initiating device or devices 12 that were tripped upon the occurrence of an alarm condition. Still further, the UI may allow an operator to manually activate one or more specified notification appliances 16 within the system 10, such as for delivering a public announcement.

A first shortcoming associated with many existing alarm systems of the type described above is that UI software applications that were implemented in such systems in the past are only capable of accommodating a limited total number of points (i.e. initiating devices and notification appliances). For example, UI applications in many existing alarm systems are configured to provide an interface for a maximum of 50,000 points. Until recently, such capacity was thought to be sufficient for most applications. However, some large-scale users of alarm systems, such as hotel chains and universities, have begun to expand their alarm systems beyond, and in some cases well beyond, the point capacities of their UI applications. One solution for handling such expansion is to modify the UI software in existing alarm systems to provide greater point capacities, but this is generally recognized as being an impractically expensive and burdensome endeavor. Instead, most large-scale users have simply resorted to installing additional workstations, each with its own, independent UI software application having an independent point capacity. For example, in the exemplary system 20 shown in FIG. 3, if a first workstation 22 and associated group of networked alarm panels 23 provide a UI capacity of 50,000 points 27, a second workstation 24 and associated group of networked alarm panels 25 may be added to provide an interface for an additional 50,000 points 29 to achieve a total of 100,000 interfaced points. This solution is not ideal, as it fails to provide a single, unified UI, and therefore requires personnel to separately monitor each of the workstations 22 and 24. This can be extremely cumbersome, especially if additional workstations are numerous and/or spatially remote from one another.

A second shortcoming associated with many existing alarm systems is commonly realized by large-scale users having multiple, remotely-located sites that require monitoring. Particularly, such users must generally employ a separate workstation having its own, independent UI at each remote site. This requires the user to employ personnel at each site to monitor the various workstations, which can be very expensive and logistically burdensome. Alternatively, referring to the exemplary arrangement shown in FIG. 4, the user may choose to employ a third party service provider to monitor the user's sites from a remote monitoring facility. Under this type of arrangement, the user is typically required to pay the service provider a substantial subscription fee, and generally must install additional data transmission components (e.g. telephone lines) in each of the alarm panels of its alarm system to facilitate communication with the monitoring facility. In addition to being very expensive, this approach generally precludes the user from being able to comprehensively monitor the status of its own alarm system in real-time.

SUMMARY

In view of the forgoing, a system and method are disclosed for allowing users of alarm systems to interface with a virtually unlimited number of alarm system points from a single UI application on a single workstation without rewriting UI software to accommodate such capacity. The system and method also may enable users to interface with alarm system points installed at a plurality of remotely-located sites from a single UI application on a single workstation.

In accordance with the present disclosure, a system and method for providing a comprehensive user interface for alarm systems are disclosed.

An exemplary embodiment of an interface system in accordance with the present disclosure can include two or more alarm system workstations, each having a user interface application installed thereon. One or more alarm panels may be connected to each of the alarm system workstations, and one or more points may be connected to each of the alarm panels. The interface system may further include a broker workstation connected to the two or more alarm system workstations, and one or more client workstations connected to the broker workstation. The interface system may further include a user interface broker installed on the broker workstation, wherein the user interface broker is configured to provide the one or more client workstations with a user interface that presents the status of, and that provides control over, all of the points.

An exemplary method in accordance with the present disclosure may be implemented for providing a comprehensive user interface for at least one alarm system having at least two alarm system workstations, each alarm system workstation having a user interface application installed thereon, at least one alarm panel connected to each of the at least two alarm system workstations, at least one point connected to the at least one alarm panel, and at least one client workstation. The exemplary method may include providing a first user interface broker that is operatively connected to each of the at least two alarm system workstations and the at least one client workstation. The exemplary method may further include the first user interface broker receiving user interface data from the user interface applications residing on the at least two alarm system workstations, and the first user interface broker providing the at least one client workstation with a user interface that presents the status of, and that provides control over, all of the points.

An exemplary user interface broker for providing a comprehensive user interface for alarm systems including at least two alarm system workstations, at least one alarm panel connected to each of the at least two alarm system workstations, at least one point connected to the at least one alarm panel, and at least one client workstation may be configured to perform a number of steps including receiving user interface data from user interface applications residing on the at least two alarm system workstations, and providing the at least one client workstation with a user interface that presents the status of, and that provides control over, the at least one point.

BRIEF DESCRIPTION OF THE DRAWINGS

By way of example, specific embodiments of the disclosed device will now be described, with reference to the accompanying drawings, in which:

FIG. 6 is a screen shot illustrating an exemplary "Alarm Lists" window of a UI broker in accordance with the present disclosure.

FIG. 7 is a screen shot illustrating an exemplary "Status & Control" window of a UI broker in accordance with the present disclosure.

DETAILED DESCRIPTION

Figure 1:
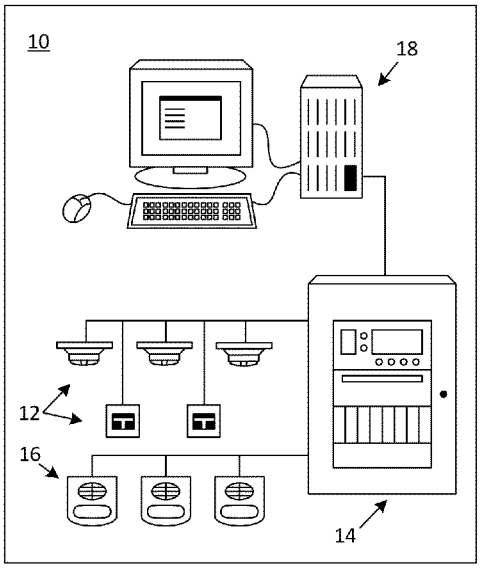
FIG. 1 (Prior art)
FIG. 1 is a schematic diagram illustrating a prior art alarm system.
Figure 3:
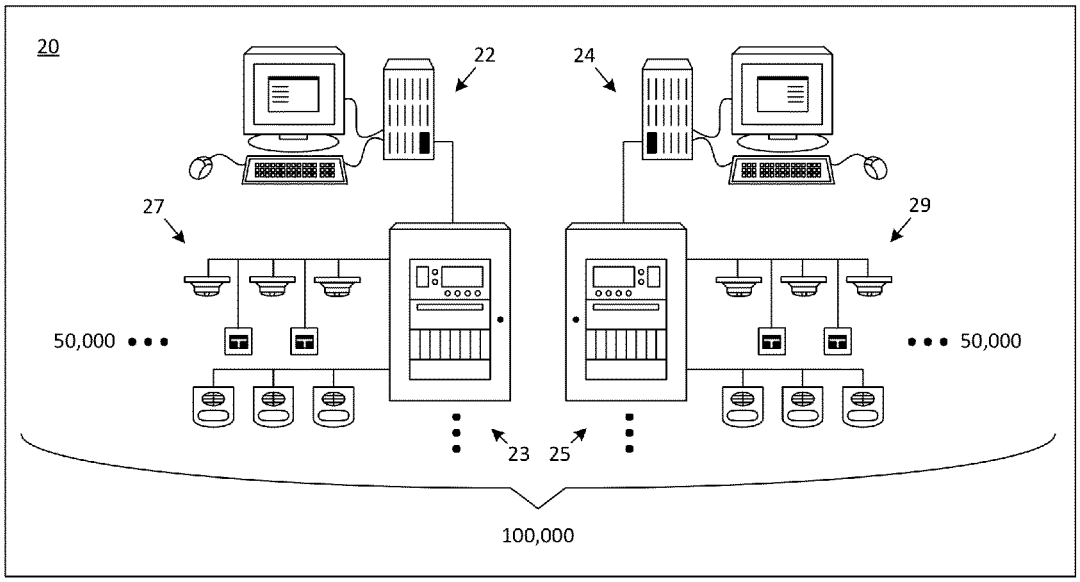
FIG. 3 (Prior art)
FIG. 3 is a schematic diagram illustrating a prior art alarm system in which multiple alarm system workstations are implemented to achieve additional point capacity.
Figure 2:
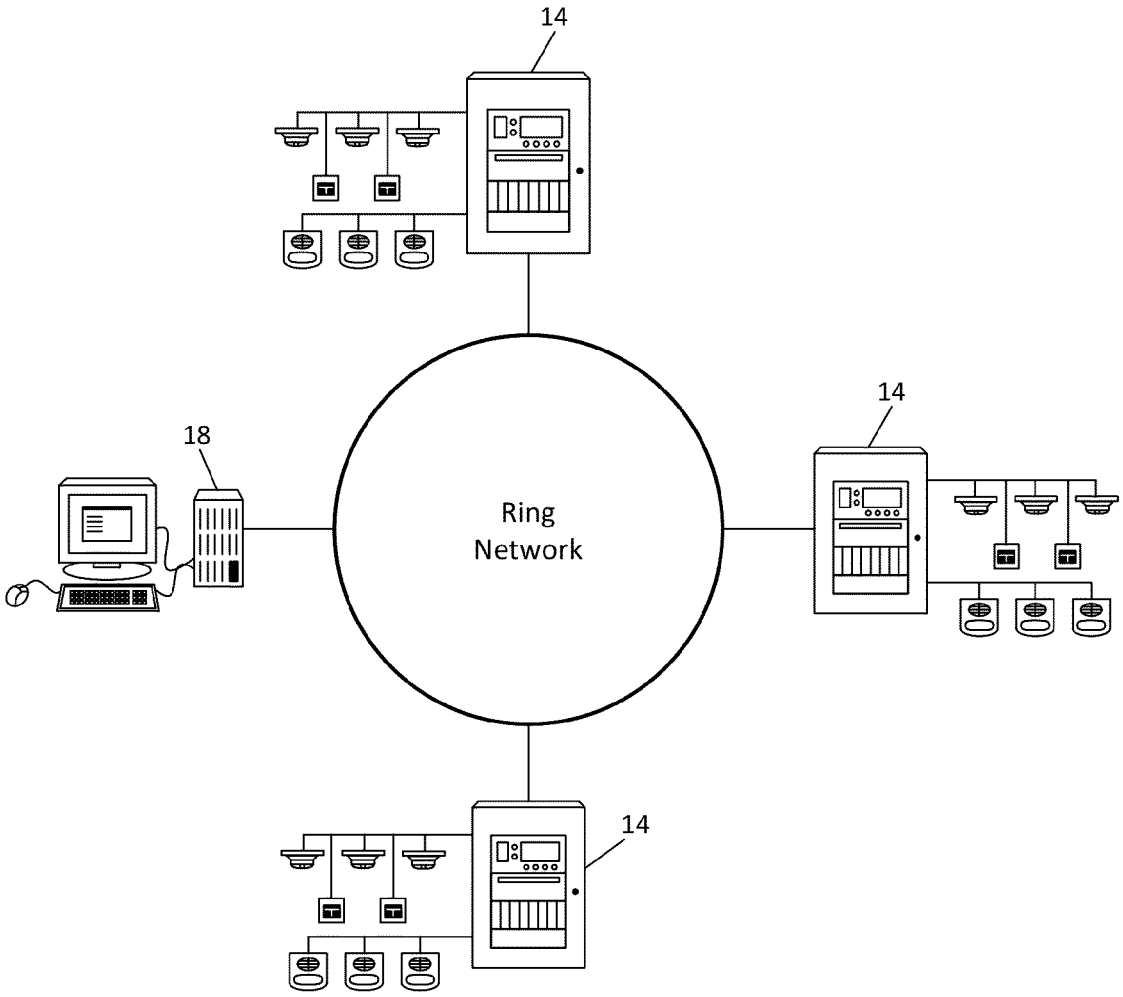
FIG. 2 (Prior art)
FIG. 2 is a schematic diagram illustrating a prior art alarm system having a plurality of networked alarm panels.

A system and method for providing a comprehensive user interface for alarm systems in accordance with the present disclosure will now be described more fully hereinafter with reference to the accompanying drawings, in which preferred embodiments of the invention are shown. This disclosed system and method, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the user interface system and method described herein may be implemented in virtually any type of alarm or monitoring system, including, but not limited to, fire alarm systems, burglar alarm systems, surveillance systems, air quality monitoring systems, inventory monitoring systems, etc., or any combination thereof, such as may be provided for detecting an alarm event (e.g. a security breach) or a warning condition (e.g. an elevated temperature) in a building, structure, enclosure, or area (collectively referred to herein as "sites"). Many other applications are contemplated and may be implemented without departing from the scope of the present disclosure. All such applications are collectively referred to herein as "alarm systems."

Figure 5:
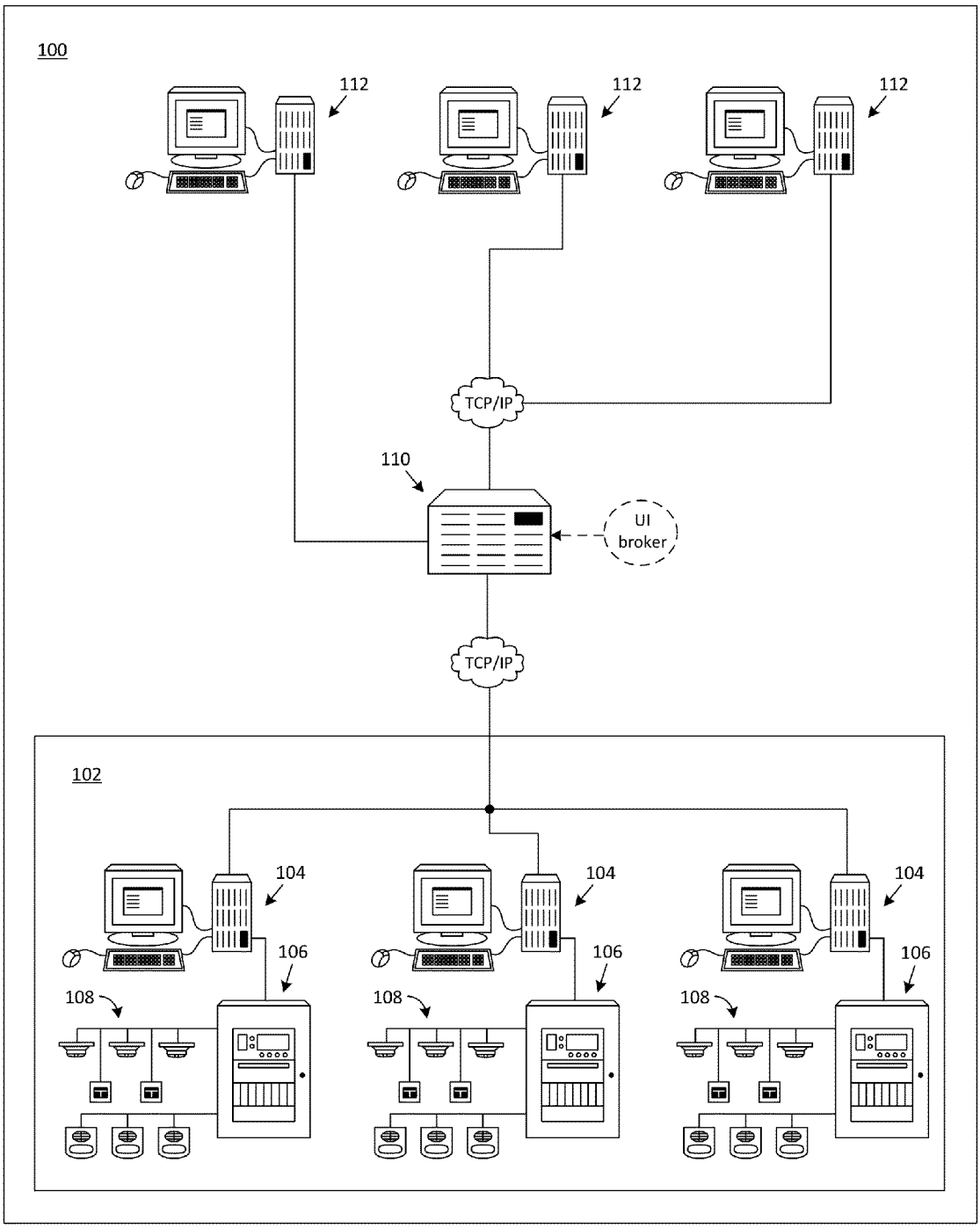
FIG. 5 is a schematic diagram illustrating an exemplary interface system in accordance with the present disclosure.

A first exemplary interface system 100 in accordance with the present disclosure is depicted in FIG. 5. The interface system 100 may include an alarm system 102 installed at a monitored site. The alarm system 102 may include two or more alarm system workstations 104, such as personal computers (PCs) or servers, which are each loaded with a user interface (UI) software application. Each alarm system workstation 104 may be operatively connected to one or more alarm panels 106, and each alarm panel 106 may in turn be operatively connected to a plurality of system points 108 (e.g. initiating devices and notification appliances) that are distributed throughout the monitored site. Each individual alarm panel 106 shown in FIG. 5 may therefore represent a plurality of interconnected alarm panels. Configured thusly, each UI application on a respective alarm system workstation 104 may provide a separate, independent UI for a plurality of points 108 in the system 102, where the number of points 108 interfaced by each alarm system workstation cannot exceed a maximum point capacity of the UI application loaded thereon. "Point capacity" is defined herein to mean a maximum number of points that a UI software application is capable of providing an interface for, such as may be defined by the parameters of the UI application software. For example, in one non-limiting embodiment the UI applications on each of the workstations 104 may each have a point capacity of 50,000 points. The point capacity of the entire alarm system 102, including each of the independent alarm system workstations 104, may therefore be 150,000 points.

The interface system 100 may further include a software application or module referred to herein as a "UI broker." The UI broker may be installed on a broker workstation 110 (such installation represented by the dashed bubble and arrow shown in FIG. 5) that is directly or indirectly connected to each of the alarm system workstations 104 via wired or wireless network connection means, such as via the Internet using transmission control protocol and Internet protocol (TCP/IP) as shown in FIG. 5. Various other network connection arrangements are contemplated, including, but not limited to, dial-up, Ethernet, token ring, etc., and may be additionally or alternatively implemented without departing from the scope of the present disclosure. The network connection is in some embodiments a secure connection, such as may be achieved through the implementation of a virtual private network (VPN) or other secure connection means. The broker workstation 110 may be located in any of a variety of locations, such as at the monitored site, at the location of one of the client workstations 112 (described below), or elsewhere.

Generally, the UI broker may be an architectural pattern for UI data validation, UI data transformation, and UI data routing. The UI broker may mediate communication amongst UI applications, minimizing the mutual awareness that applications have of each other in order to be able to exchange UI data, effectively implementing decoupling. The general purpose of the UI broker is to take incoming UI data from UI applications and perform some action on them. For example, the UI broker may perform some or all of the following actions: route UI data to one or more of many destinations; transform UI data into an alternative representation; perform UI data aggregation; decompose UI data into multiple data packets and send them to appropriate destinations, then recompose the data into a single packet to return to a user; interact with an external repository to augment UI data or store it; invoke Web services to retrieve data; and respond to events or errors.

In the present example, the UI broker may be an interface application that is configured to receive and aggregate interface data provided by each of the UI applications residing on the respective workstations 104 in the alarm system 102. Particularly, the UI broker may be configured to receive status information pertaining to each of the points 108 in the entire alarm system 102, such data being provided by each individual UI application, and may further be configured to issue command and control instructions to each of the UI applications in response to operator input as further described below.

The interface system 100 may further include one or more client workstations 112 (e.g. PCs or servers) that may be directly or indirectly connected to the broker workstation 110 via a secure, wired or wireless network connection. Such connections may be "permanent," as in the case of a client server that may be continuously connected to the broker workstation 110 from a fixed location, or "transient," as in the case of a client laptop that may intermittently connect to the broker workstation 110 from various locations. When connected to the broker workstation 110, the client workstations 112 may be provided with access to the UI broker residing thereon. The client workstations 112 may be loaded with software applications and/or authentication means (e.g. digital certificates) to facilitate secure connection and access to the UI broker.

The UI broker may provide each of the connected client workstations 112 with a UI that facilitates access to all of the points in the entire alarm system 102 as aggregated by the UI broker. Particularly, the UI broker may aggregate point configuration data provided by the UI applications residing on each of the alarm system workstations 104 connected thereto into a single data file that is sent to each client workstation 112. Thus, from the point of view of a human user, each client workstation 112 appears to be connected to a single, large, "virtual" alarm system workstation to which all of the points in the system 102 are connected. In addition, the UI broker may route global and point specific messages (e.g. command and control signals) from each client workstation 112 to appropriate alarm system workstations 104 for allowing users to access and exert control over specified points in the alarm system 102. Still further, the UI broker may monitor its connections to the various alarm system workstations 104 and may report any faults or connection issues to the client workstations 112 for display to users. Each client workstation 112 may thereby provide users with a single, comprehensive interface that facilitates observation of, and control over, all of the points in the alarm system 102 in a seamless, unified manner regardless of the point capacities of the individual workstations 104 in the alarm system 102.

FIG. 6 illustrates an exemplary screen shot of a workstation (e.g. a broker workstation, alarm system workstation, or client workstation) running the above-described UI broker. This screen shot shows an "Alarm Lists" window of the UI broker (e.g. a sub-menu of the overall UI broker application), which displays all of the alarms associated with the aggregated points being monitored by the workstation. As previously noted, these points can be located in a single building, or in a plurality of different buildings associated with the UI broker. In the "Alarm Lists" window, "Point Name" refers to an individual sensor positioned within a particular building, while "Node Name" refers to the particular building being viewed. Event refers to a particular abnormal condition associated with a particular point. Although in the illustrated embodiment the alarms are shown as being associated with a single node (i.e., Node 4), it will be appreciated that the UI broker will enable a user to view any of a variety of nodes for which the user has authorized access. Thus arranged, the disclosed UI broker enables seamless monitoring of a variety of points in a variety of locations.

FIG. 7 illustrates another exemplary screen shot of a workstation running the UI broker. This screen shot shows a "Status & Control" window of the UI broker, which allows a user to manipulate, and observe the status of, all of the aggregated points being monitored by the workstation. As noted above, these points can be located in a single building, or in a plurality of different buildings associated with the UI broker. The following exemplary operations are available inside the Status & Control window: displaying the status of a point; changing the status of a point; silencing an alarm; resetting the system; finding a point; filtering the current list of points; viewing the point graphic; adding operator's notes for a point; and viewing operator's notes for a point. Although the illustrated screen shot shows points associated with a single node (i.e., Node 4), it will be appreciated that the UI broker will enable a user to view any of a variety of nodes (on successive screens) for which the user has authorized access. Thus arranged, the disclosed UI broker enables seamless observation and control of a variety of points in a variety of locations.

As a result of implementing the above-described interface system 100, monitoring personnel are no longer required to monitor separate UI applications residing on the separate alarm system workstations 104 in order to be apprised of the status of the entire alarm system 102. Instead, personnel need only monitor and interact with a single interface on a single client workstation 112.

It is contemplated that in some embodiments the UI broker can be added to a previously-installed alarm system in a "retrofit" manner by connecting the broker workstation 110 to the existing workstations of the alarm system. Alternatively, the UI broker can be implemented as an integral component of a new alarm system installation having a plurality of alarm system workstations. In the former case, there is essentially no disruption or change to the alarm system from the point of view of a client, except that the client will interface with the UI broker instead of the individual UI applications. If a client requires additional point capacity, additional alarm system workstations can be added to the system and connected to the UI broker at any time. The UI broker may integrate the newly added points into the UI provided by the UI broker, and new points are thereby presented to a client in the unified, seamless manner described above. For example, if each of the three alarm system workstations 104 in FIG. 5 has a point capacity of 50,000 points and the system client requires a point capacity of greater than 150,000 points, a fourth alarm system workstation can be added to the alarm system to increase the total point capacity of the system 102 to 200,000 points.

Figure 8:
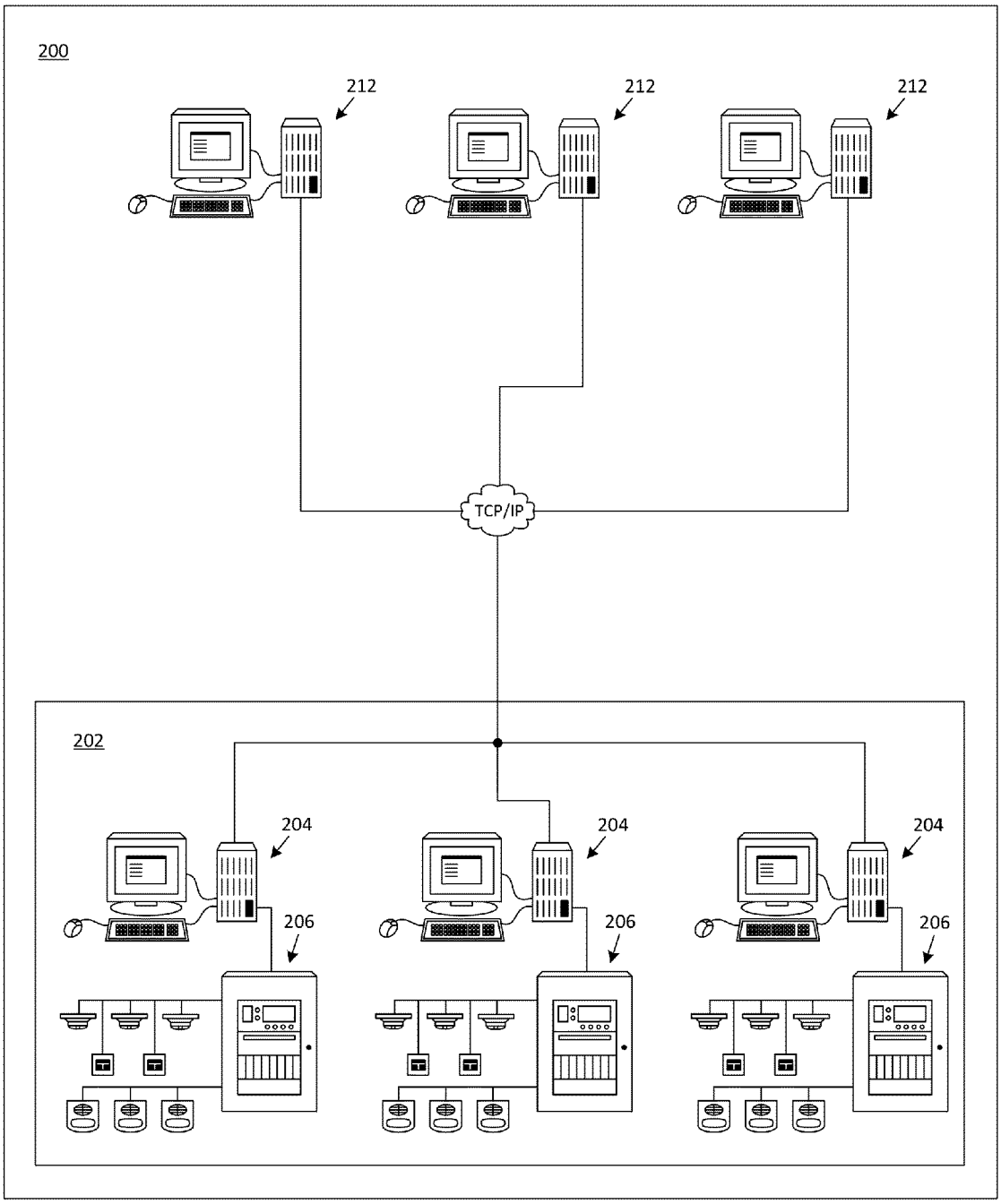
FIG. 8 is a schematic diagram illustrating an alternative embodiment of the exemplary interface system shown in FIG. 5.

Referring to FIG. 8, an exemplary alternative embodiment 200 of the interface system 100 described above is shown. The alternative interface system 200 is substantially similar to the interface system 100, except for the omission of a separate broker workstation. With this embodiment, instead of the UI broker residing on a separate, dedicated broker workstation, the UI broker may reside on one of the alarm system workstations 204 or client workstations 212 that is/are accessible by the other alarm system workstations 204 and client workstations 212 in the alarm system 202. For example, the UI broker may reside on one of the alarm system workstations 204 at the monitored site, with each of the other alarm system workstations 204 and client workstations 212 being directly or indirectly connected thereto via a secure, wired or wireless network connection. In such a case, the workstation on which the UI broker is installed may be referred to as the "broker workstation." The functional capability of the UI broker in such an embodiment may be substantially similar to the UI broker in the interface system 100 described above.

Figure 4:
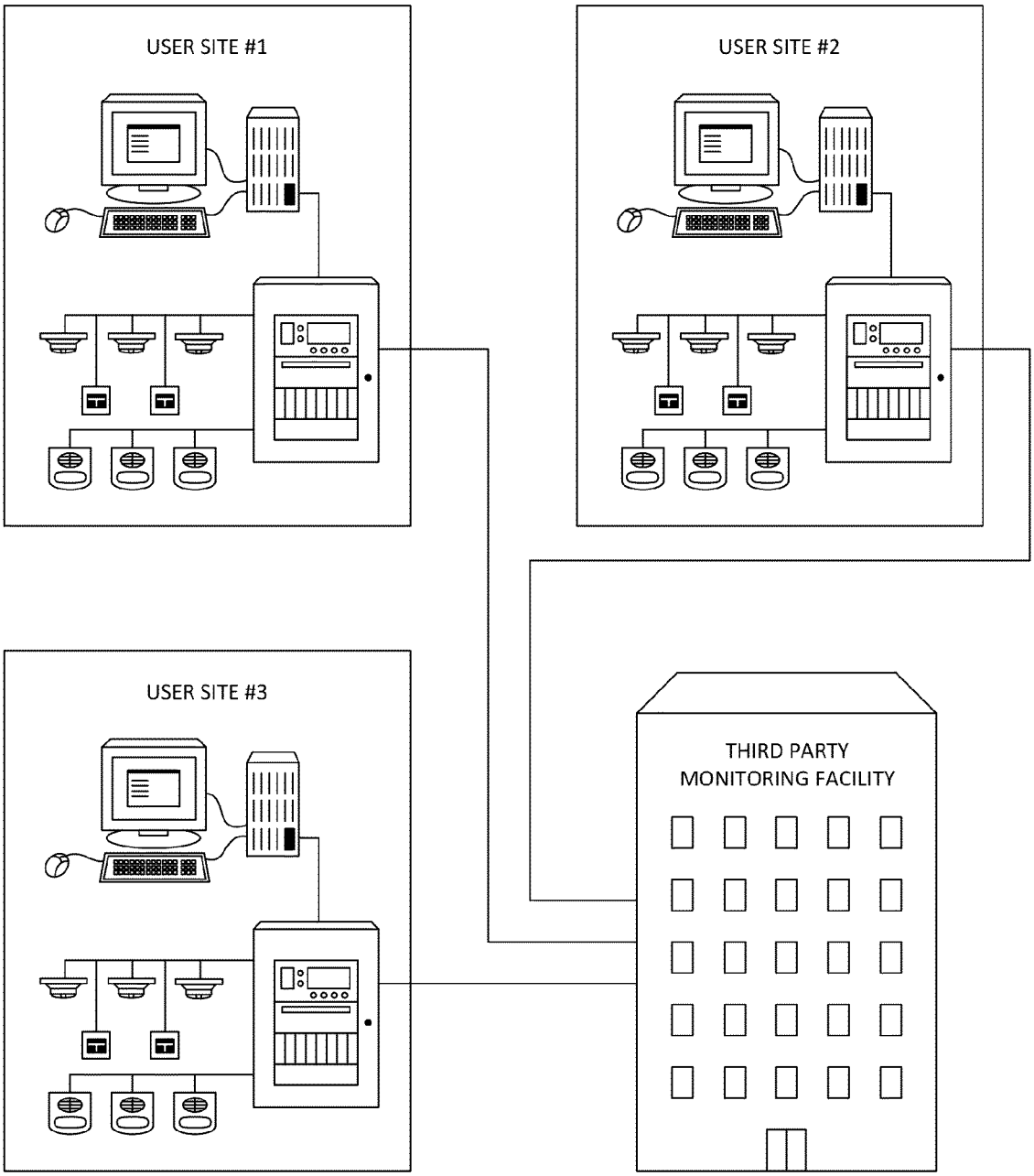
FIG. 4 (Prior art)
FIG. 4 is a schematic diagram illustrating a prior art alarm system monitoring scheme in which several alarm systems at different locations are monitored by a third-party monitoring service.
Figure 9:
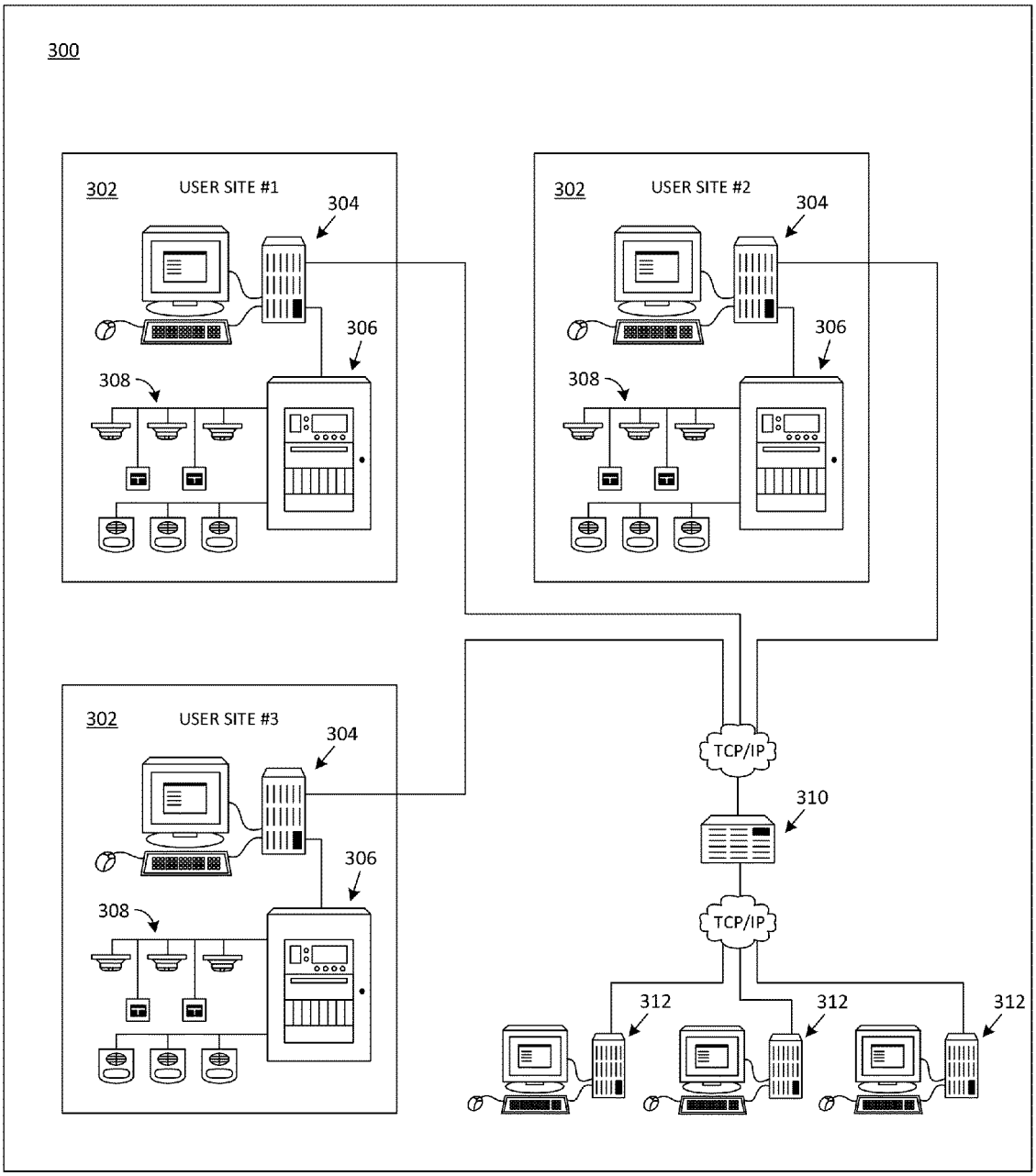
FIG. 9 is a schematic diagram illustrating an exemplary interface system in accordance with the present disclosure as used for comprehensively interfacing alarm systems located at several remote sites.

Referring to FIG. 9, an exemplary embodiment of a "multi-site" implementation of an interface system 300 in accordance with the present disclosure is illustrated. The multi-site interface system 300 may be employed by clients who have a plurality of monitored sites that are remote from one another. For example, USER SITE #1, USER SITE #2, and USER SITE #3 shown in FIG. 9 may be different buildings on a university campus, or different hotels within a hotel chain. Each of the client's sites may be equipped with independent alarm systems 302 similar to the alarm systems 102 and 202 described above, each of which may include one or more alarm system workstations 304 loaded with UI applications, one or more alarm panels 306, and a plurality of points 308. Each of the alarm system workstations 304 may be directly or indirectly connected to a broker workstation 310 via a secure, wired or wireless network connection. The broker workstation 310 may be loaded with a UI broker as described above for aggregating interface data provided by each of the UI applications residing on the various alarm system workstations 304. One or more client workstations 312 may be directly or indirectly connected to the broker workstation 310 via a secure, wired or wireless network connection, and may thereby access the UI broker on a permanent or transient basis. As in the interface systems 100 and 200 described above, the UI broker of the multi-site interface system 300 may provide clients with a single, comprehensive interface that facilitates observation of, and control over, some or all of the points 308 in the remotely-located alarm systems 302 in a seamless, unified manner. Thus, a user is no longer required to maintain personnel at each of the user sites in order to monitor each of the alarm system workstations 304, nor is there a need to enlist a third-party monitoring service to remotely monitor the all of the user sites for the client (as in FIG. 4). Instead, personnel can monitor and interact with a single interface on a single client workstation 312 to obtain a comprehensive, real-time appraisal of all of the points 308 in the various alarm systems 302. And as previously noted, additional alarm system workstations located at existing or new sites can be connected to the broker workstation 310 and integrated into the UI provided by the UI broker at any time without disrupting the client or requiring significant modification to the multi-site interface system 300.

As with the previous embodiment, the broker workstation 310 of the multi-site interface system 300 may be located in any of a variety of locations, such as at any one of the monitored user sites, at the location of one of the client workstations 312, or elsewhere. It is further contemplated that the individual broker workstation 310 may be omitted, and that the UI broker may instead reside on one or more of the alarm system workstations 304 or client workstations 312 that is/are accessible by the other alarm system workstations 312 and client workstations 304 in the alarm systems. The UI broker may reside on one of the alarm system workstations 304 at any of the monitored user sites, with each of the other alarm system workstations 304 and client workstations 312 being directly or indirectly connected thereto via a secure, wired or wireless network connection. In such a case, the workstation on which the UI broker is installed may be referred to as the "broker workstation."

Figure 10:
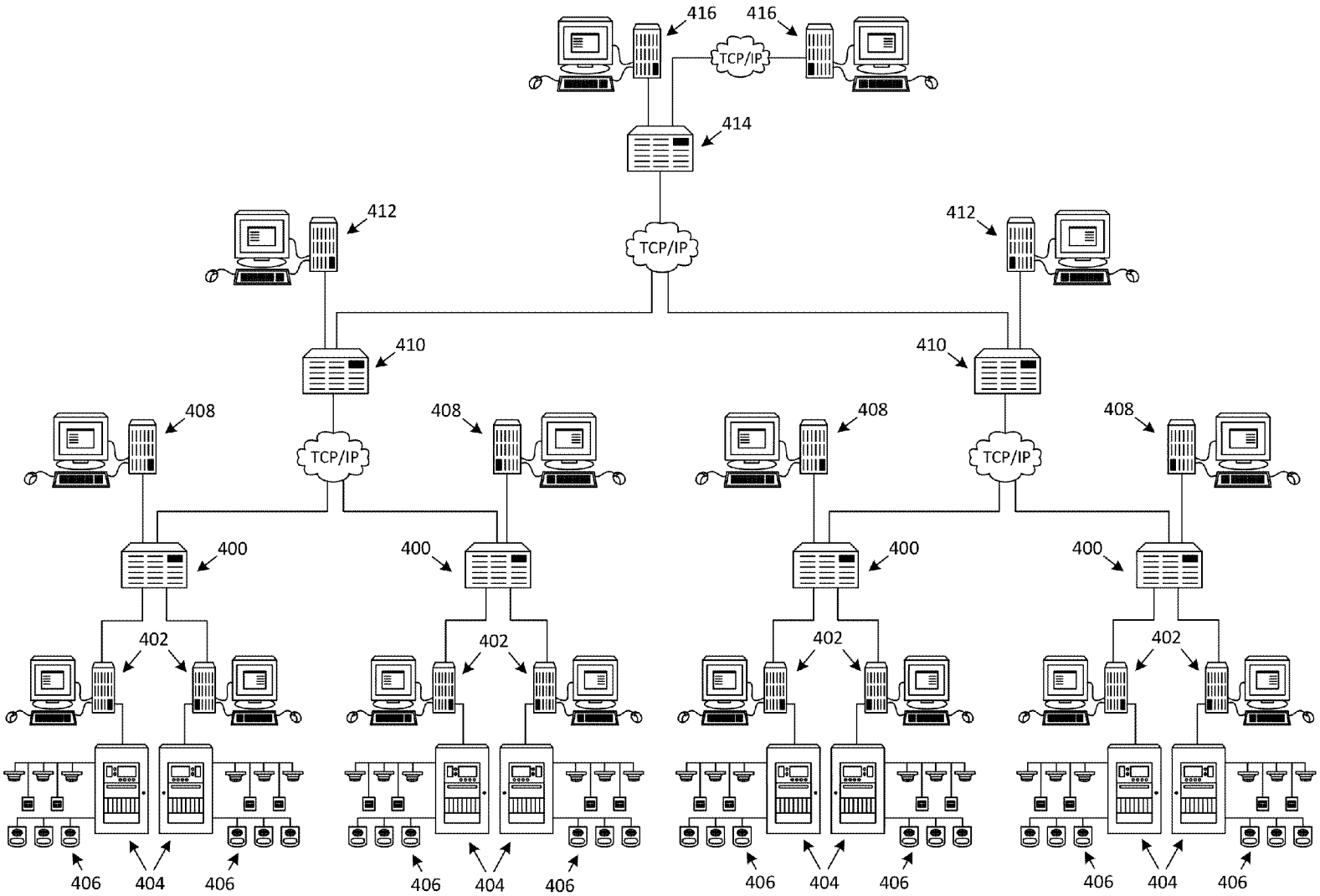
FIG. 10 is a schematic diagram illustrating an exemplary hierarchical interface topology in accordance with the present disclosure.

Referring to FIG. 10, an example of a multitier, hierarchical interface topology in accordance with the present disclosure is depicted. The topology may include a plurality of first tier broker workstations 400, each of which may be directly or indirectly connected to two or more alarm system workstations 402 via a secure, wired or wireless network connection. The alarm system workstations 402 (including alarm panels 404 and points 406 connected thereto) that are connected to each first tier broker workstation 400 may be components of a single alarm system located at a single site, or may define separate alarm systems installed at sites that are remote from one another. The first tier broker workstations 400 may each be loaded with a first tier UI broker for aggregating interface data provided by UI applications residing on the alarm system workstations 402 connected thereto. One or more first tier client workstations 408 may be directly or indirectly connected to each of the first tier broker workstations 400 via a secure, wired or wireless network connection, and may thereby access the first tier UI brokers residing on the respective first tier broker workstations 400 on a permanent or transient basis. Each of the first tier UI brokers may provide clients with a single, comprehensive interface that facilitates observation of, and control over, all of the points 406 in the alarm systems connected thereto in a seamless, unified manner.

The topology of FIG. 10 may further include a plurality of second tier broker workstations 410, each of which may be directly or indirectly connected to two or more of the first tier broker workstations 400 via a secure, wired or wireless network connection. The second tier broker workstations 408 may each be loaded with a second tier UI broker for aggregating interface data provided by the first tier UI brokers residing on the first tier broker workstations 400 connected thereto. That is, each second tier UI broker may further aggregate the aggregated interface data provided by each of the first tier UI brokers. One or more second tier client workstations 412 may be directly or indirectly connected to each of the second tier broker workstations 410 via a secure, wired or wireless network connection, and may thereby access the second tier UI brokers residing on the respective second tier broker workstations 410 on a permanent or transient basis. Each of second tier UI brokers may thereby provide connected clients with a single, comprehensive interface that facilitates observation of, and control over, all of the points 406 in the alarm systems connected thereto (i.e. via respective first tier broker workstations 400) in a seamless, unified manner.

The topology of FIG. 10 may further include a third tier broker workstation 414 which may be directly or indirectly connected to two or more of the second tier broker workstations 410 via a secure, wired or wireless network connection. The third tier broker workstation 414 may be loaded with a third tier UI broker for aggregating interface data provided by the second tier UI brokers residing on the second tier broker workstations 410 connected thereto. That is, the third tier UI broker may further aggregate the aggregated interface data provided by each of the second tier UI brokers. One or more third tier client workstations 416 may be directly or indirectly connected to the third tier broker workstation 414 via a secure, wired or wireless network connection, and may thereby access the third tier UI broker residing on the third tier broker workstation 414 on a permanent or transient basis. The third tier UI broker may thereby provide connected clients with a single, comprehensive interface that facilitates observation of, and control over, all of the points 406 in all of the alarm systems in a seamless, unified manner.

It will be appreciated that the topology depicted in FIG. 9 is but one example of the large variety of possible hierarchical configurations that may include any number of alarm system workstations and any number of broker workstations interconnected in any number of tiers. Moreover, various "hybrid" configurations are contemplated, such as wherein a second tier broker workstation may be directly or indirectly connected to two or more alarm system workstations (i.e. instead of being connected to first tier broker workstations). Such configurations may be implemented by clients who wish to organize a plurality of monitored sites into a clearly delineated hierarchy for convenient and/or partitioned monitoring.

For example, a client that may employ the topology shown in FIG. 10 may be a hotel chain in which the alarm system workstations 402 are installed in various hotels across the United States. Each of the alarm system workstations 402 that are installed in hotels within a particular state may be connected to a common, first tier broker workstation 400. The first tier UI brokers associated with the first tier broker workstations 400 may provide clients connected thereto with the ability to observe and control some or all of the alarm system points 406 located in all of the hotels in a particular state. The second tier broker workstations 410 may each be connected to two or more of the first tier broker workstations 400 that represent hotels in states that are located in a common geographic region (e.g. the Midwest). The second tier UI brokers may therefore provide clients connected thereto with the ability to observe and control alarm system points 406 located in all of the hotels in a particular geographic region. Finally, the third tier broker workstation 414 may be connected to all of the second tier broker workstations 410 and thereby represent all of the hotels in the United States. The third tier UI broker associated with the third tier broker workstation 414 may therefore provide clients connected thereto with the ability to observe and control alarm system points located in all of the hotels in the country.

It is contemplated that for practical reasons UI brokers that are higher up in a particular hierarchy may be configured to provide less detailed information regarding alarm systems connected thereto relative to UI brokers that are lower in the hierarchy. For example, a client that is connected to the national tier UI broker of the above-described hotel chain system may be interested in knowing whether an alarm condition exists in a particular hotel, but may not be interested in knowing the specific point in the hotel that initiated the alarm condition. Conversely, a client that is connected to a state, city, or local tier UI broker may be interested in knowing precisely which point in a hotel alarm system initiated an alarm condition so that the client may inform response personnel (e.g. fire or police personnel) of the location in the hotel where the condition originated.

Figure 11:
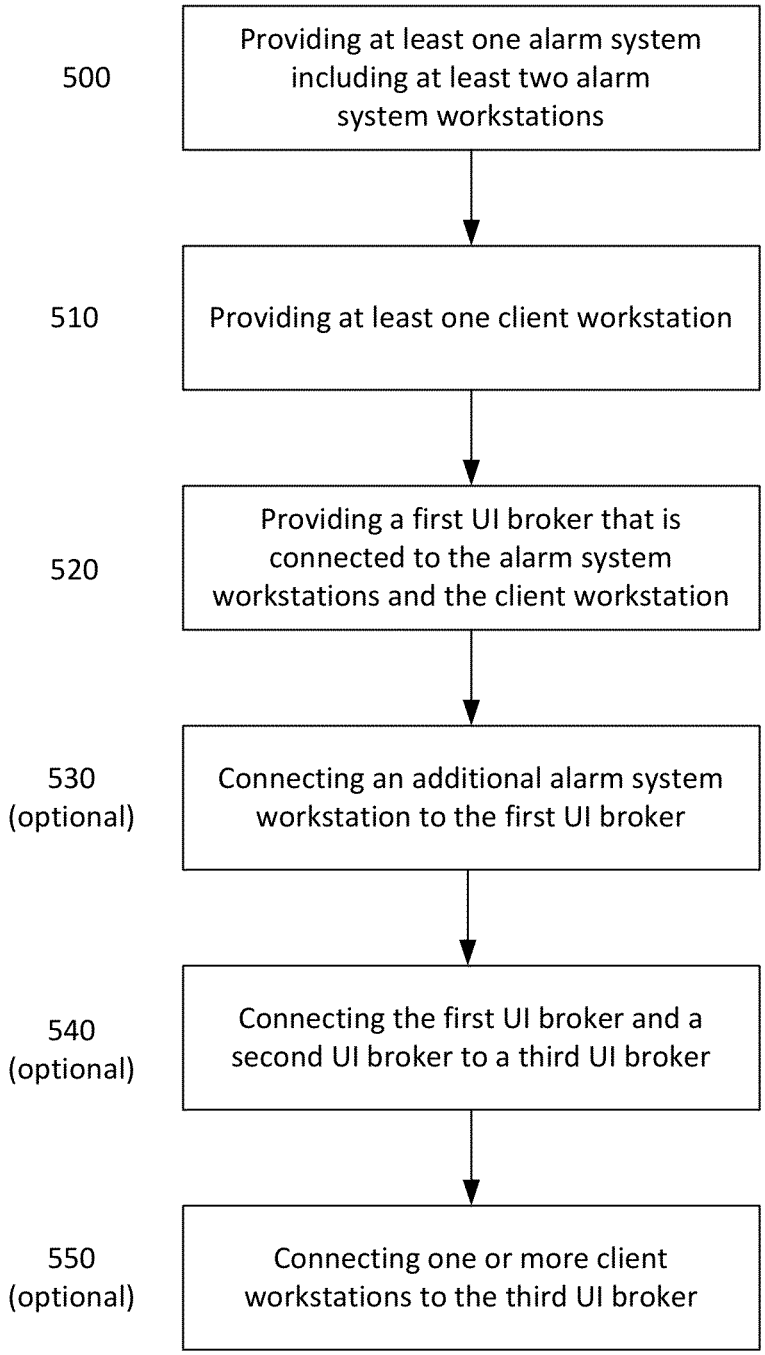
FIG. 11 is a flow diagram illustrating an exemplary method for providing an interface system in accordance with the present disclosure

Referring now to FIG. 11, a flow diagram illustrating an exemplary method for implementing an interface system in accordance with the present disclosure is shown. At a first step 500 in the flow diagram, at least one alarm system is provided, including at least two alarm system workstations, each having a user interface application installed thereon. At least one alarm panel may be connected to each of the at least two alarm system workstations, and at least one point may be connected to the at least one alarm panel. At a second step 510 in the flow diagram, at least one client workstation may be provided.

At a third step 520 in the flow diagram, a first UI broker may be directly or indirectly connected to the at least two alarm system workstations and the at least one client workstation via a secure, wired or wireless network connection. The first UI broker may be configured as described above for aggregating interface data provided by UI applications residing on the alarm system workstations connected thereto. Particularly, each alarm system workstation may send configuration data and other information to the first UI broker as though the alarm system workstation were communicating directly with a client workstation. The first UI broker may be installed on a separate broker workstation, or may be installed on one or more of the alarm system workstations or on a client workstation.

The first UI broker may provide each of the connected client workstations with a UI that facilitates access to all of the points connected to any of the alarm system workstations. Particularly, the first UI broker may aggregate point configuration data (e.g. data detailing the number, type, and location of points) and other information provided by the alarm system workstations into a single data file that is sent to each of the client workstations. The alarm system workstations continuously communicate event information and status updates relating to connected points to the first UI broker, which in turn continuously aggregates such data and sends it to the client workstations for presentation to users. The first UI broker also routes instructions and messages from each of the client workstations to appropriate alarm system workstations for allowing users to exert control over specified points in a system. Each client workstation may therefore provide users with a single, comprehensive interface that facilitates observation of, and control over, all of the points in a seamless, unified manner.

At an optional fourth step 530 in the flow diagram, an additional alarm system workstation that is connected to corresponding additional alarm panels and points may be connected to the first UI broker. The first UI broker may then access the UI application residing on the newly added alarm system workstation and may integrate the points of the workstation into the UI that is presented to the one or more client workstations in a unified, seamless manner.

At an optional fifth step 540 in the flow diagram, the first UI broker and a second UI broker may be directly or indirectly connected to a third, higher-tier UI broker workstation via secure, wired or wireless network connection means. The third UI broker may be configured as described above for further aggregating the aggregated interface data provided by the first and second UI brokers connected thereto.

At an optional sixth step 550 in the flow diagram, one or more additional client workstations may be directly or indirectly connected to the third UI broker via secure, wired or wireless network connection means. The third UI broker may provide each of the additional client workstations with a UI that facilitates access to all of the points aggregated by the first and second UI brokers. Each connected client workstation may therefore provide users with a single, comprehensive interface that facilitates observation of, and control over, all of the aggregated points in a seamless, unified manner As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above, for example, the alarm system workstations, broker workstations, and the components or processors therein, may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. An interface system for providing a comprehensive user interface for alarm systems, the interface system comprising:

at least two alarm system workstations, each alarm system workstation comprising a computing platform having a user interface application installed thereon;

at least one alarm panel connected to each of the at least two alarm system workstations;

at least one point connected to the at least one alarm panel;

at least one client workstation; and a user interface broker operatively connected to each of the at least two alarm system workstations and the at least one client workstation, wherein the user interface broker is configured to provide the at least one client workstation with a user interface that presents a single, comprehensive listing of all of the points, including statuses of the point.

2. The interface system in accordance with claim 1, further comprising a broker workstation, wherein the user interface broker is installed on the broker workstation.

3. The interface system in accordance with claim 1, wherein the user interface broker is installed on one of the at least two alarm system workstations.

4. The interface system in accordance with claim 1, wherein the user interface broker is installed on the at least one client workstation.

5. The interface system in accordance with claim 1, wherein the at least one point is an alarm system notification appliance.

6. The interface system in accordance with claim 1, wherein the at least one point is an alarm system initiating device.

7. The interface system in accordance with claim 1, wherein the at least two alarm system workstations are components of at least two, separate alarm systems.

8. The interface system in accordance with claim 1, wherein each of the at least two alarm system workstations is associated with a set of points that is not associated with another alarm system workstation.

9. A method for implementing a comprehensive user interface for at least one alarm system having at least two alarm system workstations, each alarm system workstation being a computing platform and having a user interface application installed thereon, at least one alarm panel connected to each of the at least two alarm system workstations, at least one point connected to each alarm panel, and at least one client workstation, the method comprising:

providing a first user interface broker that is operatively connected to each of the at least two alarm system workstations and the at least one client workstation;

the first user interface broker receiving user interface data from the user interface applications residing on the at least two alarm system workstations; and the first user interface broker providing the at least one client workstation with a user interface that presents a single, comprehensive listing of all of the points, including statuses of the points.

10. The method in accordance with claim 9, wherein the step of receiving user interface data from the user interface applications includes aggregating point configuration data and other information provided by the at least two alarm system workstations into a single data file.

11. The method in accordance with claim 9, wherein the step of providing the at least one client workstation with a user interface includes routing control instructions from the at least one client workstation to an appropriate alarm system workstation.

12. The method in accordance with claim 9, wherein the user interface broker is installed on a broker workstation.

13. The method in accordance with claim 9, wherein the user interface broker is installed on one of the at least two alarm system workstations.

14. The method in accordance with claim 9, wherein the user interface broker is installed on the at least one client workstation.

15. The method in accordance with claim 9, further comprising:

connecting an additional alarm system workstation to the first user interface broker; and at the user interface broker, integrating interface data provided by a user interface application residing on the additional alarm system workstation into the user interface provided to the at least one client workstation.

16. The method in accordance with claim 9, further comprising:

connecting the first user interface broker and a second user interface broker to a third user interface broker;

wherein the third user interface broker aggregates user interface data provided by the first user interface broker and the second user interface broker.

17. The method in accordance with claim 16, further comprising:

connecting at least one additional client workstation to the third user interface broker;

wherein the third user interface broker provides the at least one additional client workstation with a user interface that presents the aggregated user interface data.

18. A user interface broker for providing a comprehensive user interface for alarm systems including at least two alarm system workstations that are computing platforms, at least one alarm panel connected to each of the at least two alarm system workstations, at least one point connected to each alarm panel, and at least one client workstation, the interface broker configured to perform a number of steps comprising:

receiving user interface data from user interface applications residing on the at least two alarm system workstations; and providing the at least one client workstation with a user interface that presents a single, comprehensive listing of all of the points, including statuses of the points.

19. The user interface broker in accordance with claim 18, wherein the step of receiving user interface data from the user interface applications includes aggregating point configuration data and other information provided by the at least two alarm system workstations into a single data file.

20. The user interface broker in accordance with claim 18, wherein the step of providing the at least one client workstation with a user interface includes routing control instructions from the at least one client workstation to an appropriate alarm system workstation.

21. The user interface broker in accordance with claim 18, wherein the user interface broker resides on a broker workstation.

22. The user interface broker in accordance with claim 18, wherein the user interface broker resides on one of the at least two alarm system workstations.

23. The user interface broker in accordance with claim 18, wherein the user interface broker resides on the at least one client workstation.

* * * * *